United States Patent [19]

Cooksey

[11] 4,130,173

[45] Dec. 19, 1978

[54] APPARATUS AND METHOD FOR REDUCING FLOW DISTURBANCES IN A FLOWING STREAM OF COMPRESSIBLE FLUID

[75] Inventor: James M. Cooksey, Irving, Tex.

[73] Assignee: Vought Corporation, Dallas, Tex.

[21] Appl. No.: 593,827

[22] Filed: Jul. 7, 1975

Related U.S. Application Data

[63] Continuation-in-part of Ser. No. 185,514, Oct. 1, 1971, abandoned.

[51] Int. Cl.[2] ..... F01N 1/00; F01N 1/08

[52] U.S. Cl. ..... 181/212; 181/251; 181/268

[58] Field of Search ..... 181/46, 56, 33 R, 33 F, 181/33 H, 33 HC, 33 D, 35 R, 40–42

[56] References Cited

U.S. PATENT DOCUMENTS

| | | | |
|---|---|---|---|
| 2,169,359 | 8/1939 | Jones et al. | 181/56 |
| 3,170,483 | 2/1965 | Milroy | 181/46 |
| 3,448,825 | 6/1969 | Booth | 181/56 |
| 3,458,008 | 7/1969 | Benham | 181/33 HC |
| 3,491,850 | 1/1970 | Heitner | 181/56 |
| 3,583,417 | 6/1971 | Clark et al. | 181/33 HA |
| 3,665,965 | 5/1972 | Baumann | 181/46 |

FOREIGN PATENT DOCUMENTS

| | | | |
|---|---|---|---|
| 865661 | 4/1961 | United Kingdom | 181/33 F |

OTHER PUBLICATIONS

NACA TN-3255.

*Primary Examiner*—Ulysses Weldon

*Attorney, Agent, or Firm*—Jack A. Kanz; James M. Cate

[57] ABSTRACT

Disclosed are methods and apparatus for reducing acoustic noise generated by high pressure ratio throttling of compressible fluids. High pressure gas is passed through a plurality of chokes, each adapted to cause an incremental pressure reduction and produce a normal shock at a Mach number between about 1.3 and 2.3, thereby reducing total pressure across the system without causing a high Mach number shock.

8 Claims, 5 Drawing Figures

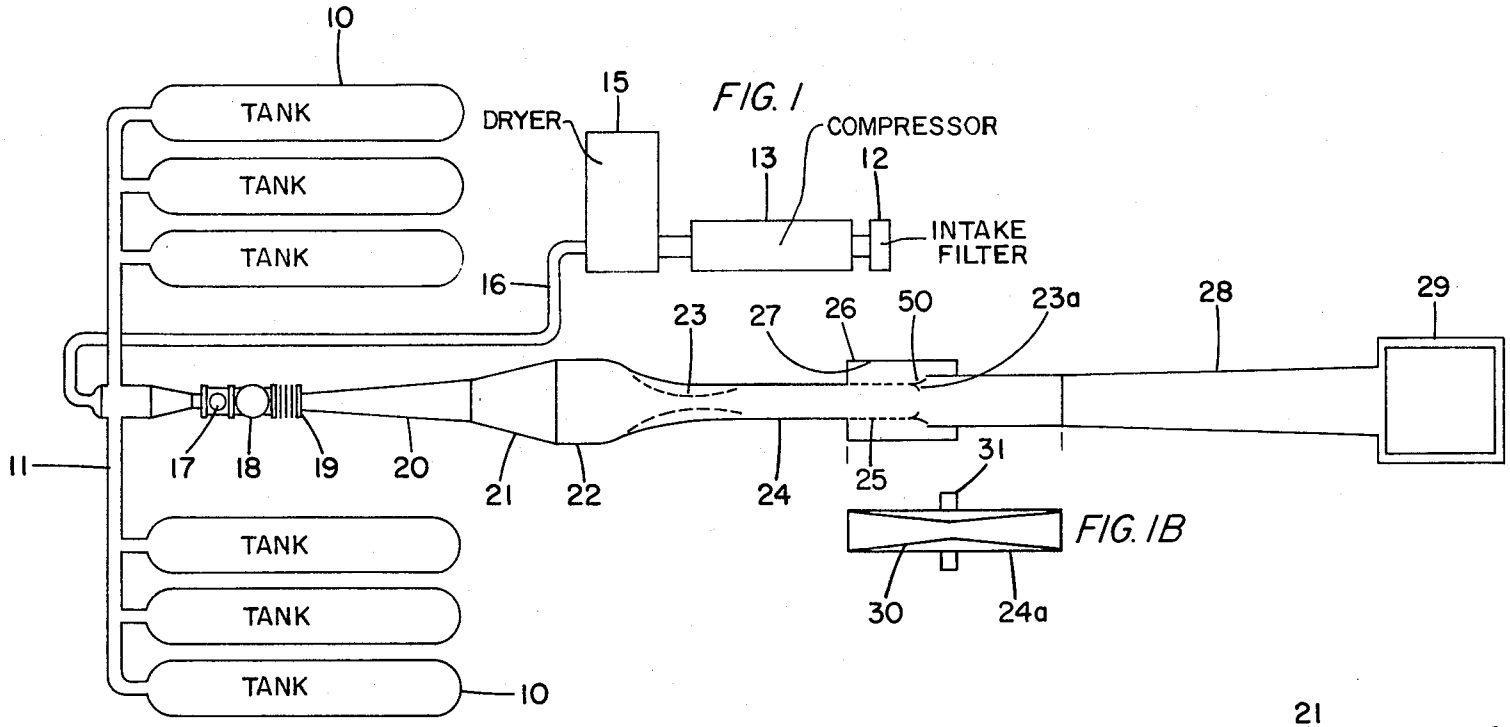
FIG. 1
FIG. 1B
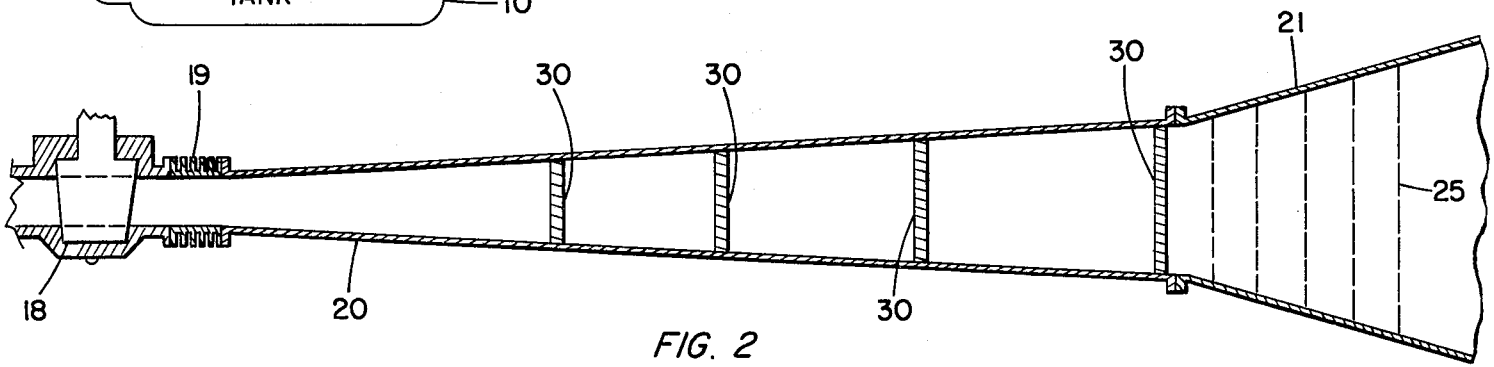
FIG. 2

APPARATUS AND METHOD FOR REDUCING FLOW DISTURBANCES IN A FLOWING STREAM OF COMPRESSIBLE FLUID

This is a continuation-in-part of co-pending application Ser. No. 185,514 now abandoned entitled "Gas Flow Control Apparatus" filed Oct. 1, 1971 and assigned to the same assignee.

This invention relates to methods and apparatus for reducing gas flow unsteadiness and acoustic noise generated by high pressure ratio throttling of compressible fluids. More particularly, it relates to methods and apparatus for inducing multiple normal shocks at low Mach numbers within the entrance diffuser of a blowdown wind tunnel or similar compressible fluid flow control apparatus.

As used herein the terms 'gas' and 'compressible fluid' are used interchangeably and mean a fluid in which the density may vary substantially as it flows through a flow system or duct. Thus a gas as used herein means a fluid which will vary in density to fill its container as distinguished from fluids in a liquid state such as water, oil, etc.

Compressible fluid moving from a high pressure region to a low pressure region obviously varies in density and velocity at various points in the duct. These changes generally produce significant noise and pressure unsteadiness in the downstream flow. Frequently it is desirable or necessary to reduce the pressure unsteadiness and noise, particularly where the gas stream is used for determining the effect of relative movement of bodies in the gas, as in wind tunnels and the like. It is generally recognized that high free stream turbulence has an adverse effect on many types of measurements made in wind tunnels. For example, buffet onset and intensity, acoustic, and other dynamic response phenomena can be at least partially masked by high tunnel noise and turbulence. Moreover, it is well known that the transition of boundary layer flow on the surface of the model from laminar to turbulent occurs at much lower Reynolds numbers in highly turbulent flow.

Various means have been found effective for reducing turbulence, but heretofore no effective means has been devised to prevent the generation of acoustic noise within a gas flow control system. For example, screens or grids are frequently employed to smooth gas flow through a high velocity system, thereby eliminating some turbulence and pressure variations. However, acoustic noise generated upstream is rapidly propogated downstream through such screens or grids without significant attenuation. In blowdown wind tunnels, for example, high pressure air flow is introduced into the test section through a pressure throttling system. When the test section is operated in the transonic range (from about Mach number 0.4 to about 1.2) energy is dissipated in the throttling process through a normal shock system. The intensity of the shock generated is, of course, a function of the pressure drop across the shock. The terms 'shock' and 'normal shock' are used herein to define a discontinuity in flow of a compressible gas as the terms are ordinarily used and understood by those skilled in this art.

It has been determined that the intensity of acoustic noise in the duct upstream of the test section is a function of the shock Mach number in the throttling system and pressure unsteadiness in the system upstream of the shock. Since the shock generates noise in the system downstream resulting from pressure unsteadiness going through the shock, high shock Mach numbers generally result in more downstream acoustic noise. In addition, the large static pressure increase through a high Mach number shock system can cause separation of the wall boundary layer, which may be unstable in nature and thereby generate downstream flow unsteadiness and noise.

In accordance with the present invention a plurality of apertured plates are positioned within the throttling system which operate as chokes to produce a stepped total pressure reduction. The chokes are designed to produce a normal shock in the vicinity of the downstream face of each plate at a shock Mach number which is relatively low, thereby replacing the strong single shock with a series of weaker shocks. Accordingly, noise resulting from pressure unsteadiness passing through the shock or from shock-boundary layer interaction is minimized. Furthermore, each choke plate has a smoothing effect on gas passing therethrough, thereby reducing turbulence approaching the subsequent shock.

The chokes may be designed to effect the same total pressure loss in a gas control system as would be produced by a single shock in the same system, thereby avoiding loss of effective run time. Furthermore, since gas velocities in the throttling system are ordinarily subsonic when the test chamber is operated at supersonic velocities, the apertures in the plates are not choked and the plates have little effect on the operation of the wind tunnel except when the test section is operated at transonic velocities.

Other features and advantages of the invention will become more readily understood from the following detailed description taken in connection with the appended claims and attached drawings in which:

FIG. 1 is a schematic illustration of a conventional blowdown wind tunnel apparatus;

FIG. 1B is a diagrammatic illustration of a supersonic diffuser section which is substituted for the perforated wall section of the wind tunnel when the test chamber is operated at supersonic velocities.

FIG. 2 is a sectional view of a shock-loss pressure ratio throttling apparatus embodying the principles of the invention;

Figure 4:
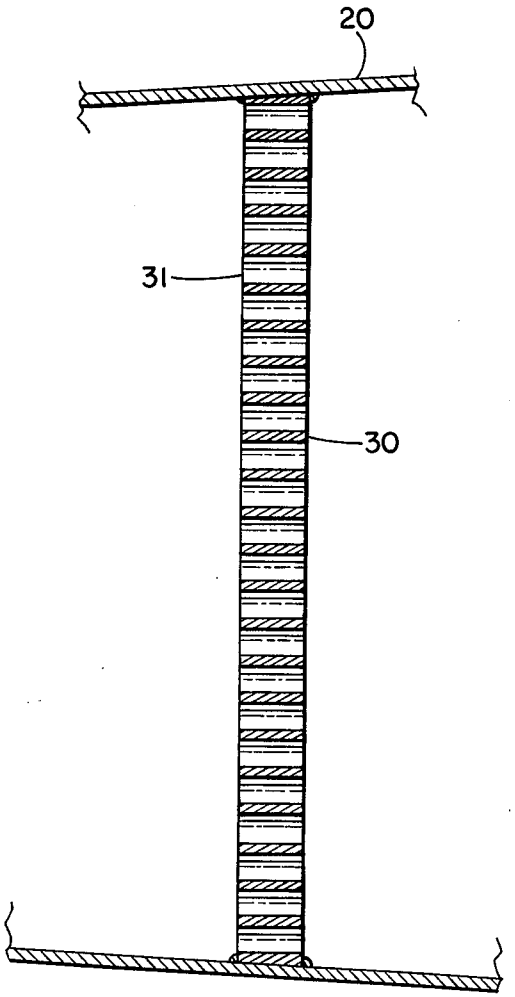
FIG. 4 is a sectional view of the choke plate of FIG. 3 illustrating the plate positioned within a section of the shock-loss apparatus.

It will be readily appreciated that methods and apparatus for reducing noise generated in high pressure ratio throttling of gases will find utility in many applications. However, for simplicity of illustration, the principles of the invention will be described with particular reference to gas flow control apparatus for blowdown wind tunnels.

As schematically illustrated in FIG. 1, a conventional blowdown wind tunnel system comprises a plurality of high pressure storage tanks 10 interconnected by means of a manifold header 11. The storage tanks 10 are usually filled by air drawn through an intake filter 12 by compressor 13 and forced through a dryer 15. The dry compressed air is then forced through a high pressure line 16 into the manifold 11 and stored under pressure in tanks 10.

The number and size of the storage tanks will depend, of course, on the design requirements of the test section. For purposes of illustration, the invention will be described with reference to use in a wind tunnel of conventional design having a 4 ft. by 4 ft. test section. In a wind tunnel of this type the storage reservoir pressure may be as high as 600 psia.

Air from the pressurized tanks 10 is released into the wind tunnel through a gate valve 17. Gas flowing through gate valve 17 passes through a control valve 18 and into a conical diffuser 20 through an expansion joint 19. The air then flows through a wide angle diffuser 21 into stilling chamber 22, through a variable nozzle 23 and into the test section.

When operated in the transonic range, the test chamber 24 may have perforated walls 25 surrounded by an enclosure 26. Air may be pumped by ejector action of the main stream, controlled by adjustable flaps 50 into the annular chamber 27 formed by the perforated walls 25 and the enclosure to obtain transonic or sonic flow conditions in the test chamber. Mach numbers below 1.0 may be established and controlled by adjustable choke flaps **23*a* in addition to controlled flow removal through the perforated wall 25. When the test chamber is operated at supersonic velocities, the perforated wall section is replaced by a supersonic diffuser section 24*a* as illustrated in FIG. 1B. Supersonic diffuser section 24*a* has adjustable sides 60 which are moveable by hydraulic jacks 61 to adjust the diffuser throat to the dimensions desired. Air exits the test section through a fixed diffuser 28 and exhaust muffler 29**.

In conventional operation the gate valve 17 is opened to allow air flow from the storage tanks through the manifold 11 into the tunnel. In order to provide a substantially constant dynamic pressure during the testing period, the control valve 18 is first opened rapidly so that the entire system is quickly charged to its operating pressure. Thereafter the control valve moves so that constant pressure is maintained in the stilling chamber 22. This may require initial valve movement to the full open position in about one second of time, followed by throttling back toward a closed position approximately one second later. The control valve 18 is then gradually reopened as pressure drops in the storage tank.

Air entering the tunnel through control valve 18 enters the conical diffuser 20 under very high total pressure. As the air expands and the static pressure decreases, a normal shock is generated and the air passes from the diffuser 20 through the wide angle diffuser 21 into a stilling chamber 22. The low total pressure air exits stilling chamber 22 through a flexible nozzle 23 into the test section 24. Conventionally, grids and screens 62 may be positioned in the wide angle diffuser and the stilling chamber to smooth the gas flow.

Obviously pressure unsteadiness in the stilling chamber will be propogated into the test section. Therefore, every effort is made to minimize turbulence or pressure unsteadiness including acoustic noise anywhere in the system.

To produce an airstream of the desired Mach number and dynamic pressure in the test section, high total pressure air in the reservoir must be converted to lower total pressure air moving uniformly through the test section. This is accomplished with a gas flow control system comprising the control valve 18, diffuser 20, wide angle diffuser 21, stilling chamber 22 and exit throat 23 or **23*a*. In order to produce as uniform gas flow as possible in the test section, a large area low velocity section termed a stilling chamber is provided immediately upstream of the exit throat or nozzle. Since the Mach number and dynamic pressure of the gas stream in the test section is directly related to the total pressure in the stilling chamber and the area of the exit throat, means must be provided to throttle the gas from a maximum pressure of about 600 psia to the desired stagnation pressure of the stilling chamber. When the test section is operated in the transonic range, a large pressure drop must occur in the upstream system, resulting in a normal shock which occurs in the diffuser 20**. The intensity or shock Mach number is dependent on the pressure drop. Therefore, since the total pressure in the stilling chamber is maintained constant while the pressure in the reservoir decreases, the shock Mach number may be initially as high as 6 and gradually reduce during the run.

As pointed out above, acoustic noise downstream in the system is a function of pressure unsteadiness passing through the shock and the intensity of the shock. Turbulence will be generated by high pressure air passing through the inlet control valve and the turbulence passing through a high Mach number shock generates acoustic noise which is propogated through the entire system and into the test section. Further, the large static pressure increase across the shock can induce unsteady separation at the wall of the diffuser 20, which also creates downstream pressure unsteadiness. The problems caused by turbulence generated by entrance regulators have been previously recognized and discussed. For further understanding of the degree of concern about such problems and the desire in the field for a solution to such problems, reference may be had to Pope, Alan and Goin, Kennith L., *High-Speed Wind Tunnel Testing*, John Wiley & Sons, Inc., New York, 1965, particularly pages 95 and 96. Prior to the invention herein disclosed, the solution to the problem had remained unsolved.

It has been determined that acoustic noise generated by shock turbulence interaction is minimum at a shock Mach number of about 1.6 and that noise generated by shock turbulence interaction increases with either decreasing or increasing shock Mach number from the minimum point. Therefore it is desirable to maintain the shock Mach number in the pressure ratio throttling system with the range of 1.3 to 2.3, and preferably near 1.6.

Figure 3:
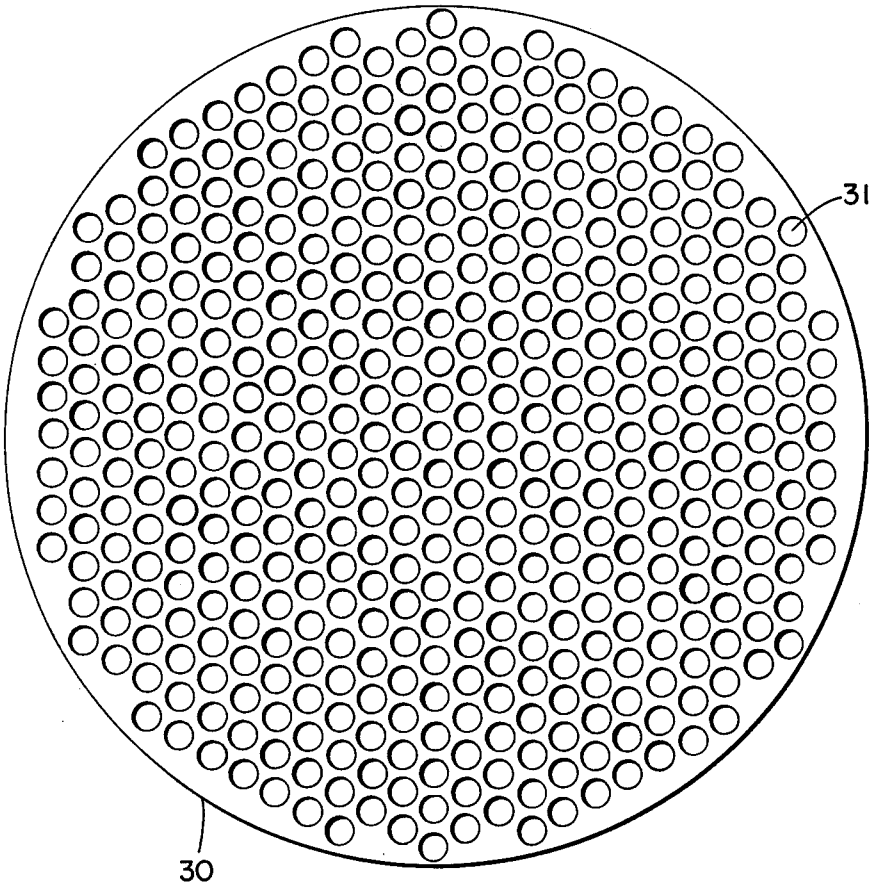
FIG. 3 is a plan view of a typical choke plate of the invention.

In accordance with the invention, normal shocks having shock Mach numbers within the preferred range are produced within the diffuser 20 by disposing therein a plurality of plates as illustrated in FIGS. 2, 3 and 4. The plates 30 are positioned perpendicular to the axis of the diffuser 20 and linearly spaced throughout the diffuser. Each plate has a plurality of holes 31 passing transversely therethrough parallel to the central axis of the diffuser 20 and is designed to operate as a choke and thereby effect a pressure reduction in the vicinity of each plate. As used herein the term 'choke' is used to mean a point of minimum cross-sectional area in a duct or flow system at which compressible fluid flow therethrough is at a velocity of Mach 1.0 and cannot exceed Mach 1.0 regardless of changes in pressure differential thereacross. The term should not be confused with chokes as used in liquid flow systems wherein a constriction is provided to retard fluid flow. Since liquids do not vary in density, the velocity of flow of a liquid therethrough is dependent only on viscosity and pressure thereacross. For more complete understanding of the terms 'choke' and 'choked flow' as used herein and as understood by those skilled in this art, reference may be had to Shapiro, Ascher H., *The Dynamics and Ther-*

*modynamics of Compressible Fluid Flow*, The Ronald Press Company, New York, 1953, particularly Volume 1, pages 89 and 90.

It will be appreciated that intentionally causing choked flow to occur within the throttling system is directly contrary to all previous teachings of wind tunnel design. In fact, the accepted authority on the subject, *High-Speed Wind Tunnel Testing*, supra, specifically advises against the use of any choke means and warns of dire consequences if choked flow should occur even accidentally. However, in direct contrast with the teachings of the art, it has been discovered that chokes positioned within the diffuser as described herein produce a beneficial graduated pressure reduction and unexpectedly significantly reduce downstream noise without causing any adverse effects.

In accordance with the invention, the design characteristic of the choke plates, i.e., the number and porosity of each choke plate, is determined by the following ratio:

$$r^n = A_o^*/A_{v_{max}}^*$$

where r is the pressure ratio across each choke plate, n is the number of choke plates, $A_o^*$ is the exit sonic throat area, and $A_{v_{max}}^*$ is the full open area of the inlet valve. Since the described system is intended to control gas flow in the shock-loss apparatus of a wind tunnel operating at transonic velocities, $A_o^*$ is the exit throat area at an operating velocity of about Mach 1. When the shock Mach number at each plate is determined within the preferred range of 1.3 to 2.3, r can be readily calculated. The porosity of the choke plate necessary to effect the necessary pressure loss can be determined from the following expression:

$$A_i^* = \frac{A_o^*}{r^i} \; (i = 1 \longrightarrow n)$$

where i indicates the order number of the plate with plate 1 immediately upstream of the stilling chamber.

When the wind tunnel test section is operated in the trans-sonic range, the exit throat will be defined by the flaps 23*a* as shown in FIG. 1 or by the minimum cross-sectional area of the conduit downstream from the choke plates in the diffuser 20.

It will thus be observed that gas flow is choked at each plate as it passes through the diffuser 20, each choke inducing a normal shock in a Mach number range of 1.3 to 2.3. The gas stream then proceeds through a subsequent plate and subsequent shock at approximately the same Mach number until the desired pressure reduction is accomplished. It will be noted, however, that although the total pressure reduction required is accomplished in the same length of diffuser apparatus as would be required by conventional systems, a plurality of low intensity shocks is induced at spaced locations in the diffuser to avoid the single high intensity shock which would normally occur. Furthermore, forcing the gas through the orifices in each plate has a smoothing effect on the gas stream; reducing the turbulence passing through each subsequent shock and producing a more uniform velocity distribution across the exit section of the diffuser 20.

In the apparatus illustrated a conventional 6° conical diffuser is utilized. Therefore, the porosity of the plates may be the same for each subsequent plate. However, the cross-sectional area of the plates will increase as required by the above expression. Similar results may be obtained by using a cylindrical conduit and increasing the porosity in each successive choke plate to maintain a shock Mach number at each plate of about 1.3 to 2.3.

However, by maintaining porosity constant for each plate, the location of each plate will be determined by desired pressure loss, and therefore shock Mach number, across each plate. Thus in the conical diffuser the location of each plate will be determined to optimize smoothing of the gas flowing therethrough.

After passing through the shock-loss apparatus as described, air enters the stilling chamber 22 at the desired reduced pressure. However, the air stream is more uniform and the acoustic noise generated by turbulence passing through a high intensity shock and by shock-boundary layer interaction is reduced. Therefore, downstream acoustic noise and turbulence is drastically reduced.

As indicated by the expression above, the shock-turbulence noise level decreases with increasing number of choke plates. However, the noise level approaches a minimum value somewhat exponentially.

The number of choke plates should be limited to a sufficient number to effect significant noise reduction without introducing a significant loss in overall flow efficiency. In systems wherein pressure is reduced from about 600 psia to near atmospheric, as in the conventional wind tunnel described, when operating at transonic speeds the optimum number of plates is about three to five and preferably four. Using the expression above for the wind tunnel described, the $A_o^* : A_{v_{max}}^*$ ratio is 1:5. For a shock Mach number at each plate of 2.12, r=1.504. Accordingly, four plates are required.

The choke plates are preferably rigid steel discs firmly secured to the walls of the entrance diffuser. A four inch steel plate with two inch holes has been found suitable. For the conditions above the open area to closed area of the plate is about 2:1. It will be understood however, that once r is determined, the porosity and respective location of each choke plate within the system may be readily calculated.

It will be observed that the method and apparatus described above produces a pressure drop across each choke plate at a relatively constant shock Mach number. Accordingly the pressure drop across the system occurs step-wise. The largest pressure drop occurs at the upstream plate and total pressure decreases in diminishing steps across the downstream plates. It will be readily understood, however, that the same principles may be applied to produce the same total pressure decrease across the system by causing equal pressure drops across each plate. In this case, shock Mach number will increase at each succeeding downstream plate. Accordingly, the system may be designed with the upstream plate adapted to produce a shock Mach number of about 1.3 and each succeeding plate producing a shock at a slightly higher Mach number, the final downstream plate producing a shock at about Mach 2.3. In either case the same total pressure drop across the system is achieved while maintaining the maximum intensity shock within the preferred range.

It should be observed that the apertured plates 30 only operate as chokes when there is a sufficient critical pressure drop across the plate to cause sonic flow in the throat of the choke. Obviously no normal shock can occur until choked conditions are achieved in the choke, i.e., until flow through the choke is at Mach 1. Therefore, when flow through the diffuser is maintained subsonic, as when the test section is operated at supersonic velocities, the plates 31 have little or no effect on the gas passing therethrough. However, to operate in the trans-sonic range, energy must be dissipated in the diffuser. To accomplish the required pressure drop, a normal shock is induced. However, to produce a normal shock, the gas must be accelerated to supersonic velocities. To accelerate a gas from subsonic to supersonic, the flow must be choked. For further understanding of the dynamic principles involved, reference may be had to *The Dynamics and Thermodynamics of Compressible Fluid Flow*, supra, and Liepman, Hans Wolfgang and Puckett, Allen E., *Introduction to Aerodynamics of a Compressible Fluid*, John Wiley & Sons, Inc., 1947, Chapter 4.

Using the principles of the invention described above, shock means positioned in the entrance diffuser of a blowdown wind tunnel have been found effective to appreciably reduce downstream noise and pressure fluctuations. Furthermore, the magnitude of valve induced flow angularities is greatly reduced.

From the foregoing it will be observed that the principles of the invention may be utilized to reduce noise generation in many systems wherein a gas stream is subjected to a pressure loss of a degree sufficient to induce a normal shock. For example, many industrial installations frequently periodically vent high pressure gases to atmosphere, resulting in the formation of a noise generation shock. Much of the noise generated may now be eliminated by reducing the pressure in gradual steps in a plurality of low intensity shocks as described herein.

While the invention has been described with particular reference to specific embodiments thereof, it is to be understood that the forms of the invention shown and described in detail are to be taken as preferred embodiments of same, and that various changes and modifications may be resorted to without departing from the spirit and scope of the invention as defined by the appended claims.

What is claimed:

1. Apparatus for controlling reduction of pressure in a flowing compressible fluid comprising:

(a) conduit means having a central axis, (b) an inlet valve and an exit throat at opposite ends of said conduit means, (c) a plurality of choke means positioned at spaced locations within said conduit, the number and characteristics of said choke means determined by $$r^n = A_o^*/A_{v_{max}}^*$$

where r is the desired pressure ratio across each choke means when gas is flowing through said exit throat at sonic velocity, n is the number of said choke means, $A_o^*$ is the exit throat area, and $A_{v_{max}}^*$ is the full open area of the inlet valve.

2. Apparatus as defined in claim 1 wherein each of said choke means is a plate positioned substantially perpendicular to said central axis and has a plurality of orifices passing therethrough substantially parallel to said central axis.

3. Apparatus as defined in claim 2 wherein said conduit is a conical chamber and each of said choke means has about the same porosity.

4. Apparatus for controlling the flow of gas from a high pressure region to a low pressure region comprising:

(a) conduit means having an inlet at one end and an exit throat at the opposite end, (b) a plurality of choke means positioned within said conduit means, each of said choke means adapted to effect a pressure loss thereacross under gas flow conditions therethrough sufficient to cause a normal shock at a Mach number in the range of about 1.3 to 2.3.

5. Apparatus as defined in claim 4 wherein said choke means comprises plates positioned between said inlet and said exit, each plate having a plurality of holes therein; the total pressure loss across each of said choke plates decreasing in the direction of gas flow; and the Mach number of the shock occurring at each plate being substantially the same for each plate.

6. Apparatus as defined in claim 4 wherein said choke means comprises plates positioned between said inlet and said outlet, each plate having a plurality of holes therein; the total pressure loss across each of said choke plates being substantially the same; the shock occurring at the upstream plate at a Mach number of not less than about 1.3; and the shock occurring at each successive downstream plate at a higher Mach number; the shock occurring at the final downstream plate at a Mach number of not more than about 2.3.

7. The method of reducing noise generation in a gas stream flowing from a high pressure region to a low pressure region comprising the step of inducing a plurality of low intensity normal shocks in said gas stream, each shock occurring at a shock Mach number in the range of from about 1.3 to about 2.3.

8. The method of reducing noise generated in a conduit conducting a gas stream from a high pressure region to a low pressure region comprising the steps of passing said gas through successive choke means, each choke means establishing a pressure loss thereacross sufficient to cause the generation of a normal shock at a Mach number of about 1.3 to about 2.3.

* * * * *